US005305818A

United States Patent [19]

Darsy et al.

[11] Patent Number: 5,305,818

[45] Date of Patent: Apr. 26, 1994

[54] PROCESS FOR PRODUCING A MOULDED PART, MADE OF ALUMINIUM OR AN ALUMINIUM ALLOY, EQUIPPED WITH INTEGRATED CHANNELS

[75] Inventors: Eric Darsy, Chateauroux; Philippe Meyer, Nogent/sur/Oise, both of France

[73] Assignee: Montupet S.A., Levallois Perret, France

[21] Appl. No.: 737,721

[22] Filed: Jul. 30, 1991

[30] Foreign Application Priority Data

Aug. 2, 1990 [FR] France ..... 90 10487

[51] Int. Cl.[5] ..... B22D 19/00

[52] U.S. Cl. ..... 164/98; 164/112

[58] Field of Search ..... 164/98, 112, 76.1, 91, 164/100, 108

[56] References Cited

U.S. PATENT DOCUMENTS 3,848,666 11/1974 Valdo ..... 164/98

FOREIGN PATENT DOCUMENTS 2379340 10/1978 France ..... 164/98
55-73455 6/1980 Japan ..... 164/98
55-97861 7/1980 Japan ..... 164/98
59-34472 8/1984 Japan ..... 164/98
8700779 2/1987 World Int. Prop. O. ..... 164/98

*Primary Examiner*—Paula A. Bradley
*Assistant Examiner*—Rex E. Pelto
*Attorney, Agent, or Firm*—Dennison, Meserole, Pollack & Scheiner

[57] ABSTRACT

The disclosure relates to a process for producing molded parts, made of aluminum or an aluminum alloy and having integrated channels intended for the distribution of a lubricant or for the circulation of a liquid coolant. In the process one or more tubes, made of aluminum or an aluminum alloy and previously formed, are placed in a mold, the ends of the tube or tubes being on the outside of the mold or of the cores inserted therein. The aluminum or alloy is poured into the cavity of the mold, and after demolding, the surplus portions of the tube or tubes are eliminated. This process is used for the mass production of molded parts having a system of internal channels, such as cylinder heads, compressor cylinders, lubrication systems, convectors, etc.

12 Claims, 3 Drawing Sheets

PROCESS FOR PRODUCING A MOULDED PART, MADE OF ALUMINIUM OR AN ALUMINIUM ALLOY, EQUIPPED WITH INTEGRATED CHANNELS

BRIEF BACKGROUND OF THE INVENTION

The invention relates to a process for producing moulded parts made of Al or an Al alloy and comprising integrated channels with a view to the distribution of a lubricant or to the circulation of a liquid coolant.

it applies especially to the manufacture of cylinder heads.

There is known a process of this type, which is described in Japanese Patents JA-55-73455 and JA-55-68168 in which a metallic tube filled with sand or a similar material is embedded in a moulded part. After solidification the sand is removed. However, this method has the following disadvantages:

before casting, it is necessary to fill the tubes with sand, which constitutes an additional and tricky operation, especially if the tubes are narrow and tortuous;

after casting, it is necessary to remove the sand contained within the channels, which may be difficult if the channels are narrow and tortuous;

it may not be possible to remove grains of sand remaining caught up on the internal walls of the tube, which may lead to difficulties if these grains are subsequently drawn into the application circuits (for lubricating or cooling);

difficulties in refrigerating the tubes during casting.

The applicant, wishing to obviate these difficulties, has thus developed the following method according to the invention.

One or more main tubes, made of aluminum or an alloy thereof and previously formed and optionally equipped with one or more taps, is/are placed in the mould, in a specified position, the open ends of the tubes being able to correspond with the outside of the mould, either through the latter or through cores; the closed ends may be embedded in the part.

The alloy of the part is then poured into the cavity of the mould after closure of the latter, in order to embed the tube or system of tubes.

The alloy constituting the tubes and their thicknesses are specified in such a manner as to avoid any local melting during the filling of the mould with the liquid alloy. It is generally recommended to use a tube of A5 (AFNOR-NF-57702 Standard) of thickness greater than or equal to 1 mm. The bend radii of the tubes must not generate, in the stretched fibre of the elbows, thickness reductions which are too great and are incompatible with the strength of the tube when filling the mould; preferably the bend radius is greater than or equal to 3 times the external diameter of the tubes.

The taps are fixed on the main tube:

a) either by collars, which are obtained by axial compression of the tube and are formed to the external diameter of the main tube. Fixing then takes placed by adhesive securement or welding. The positioning is given by the collar and the fit of the tap in the main tube (FIG. 2);

b) or by press-fitting the chamfered end of the tap into an orifice of the main tube with a positive oversize ranging up to 0.5 mm. The positioning is given by the end of the longitudinal ribs of the taps ensuring the lateral interference (FIG. 3);

c) or by direct welding.

The depth of penetration of a tap into the main tube is of the order of 1 mm in relation to its internal surface. This positioning is fixed by the position of the collar in case a) or by external longitudinal ribbing, by embossing, of the end of the fitting in case b). In the latter case, the resulting diametral thickening ensures the lateral interference in this case and the end flanges of the ribs ensure the axial positioning of the fitting on the tube. The positioning of the tube (or of the system of tubes) in the mould ensures its centring in relation to its reference position, which allows for axial expansion of the tubes and the rotary blocking of the latter.

The positioning of the tube (or the system of tubes) in the mould is achieved for example by an elbow at 90° external to the useful portion of the moulded part and inserted into a core adjacent to the mould with a clearance of the order of 1 to 2 mm, for an overall length of approximately 50 cm. The other end of the tube is inserted into a cylindrical housing core permitting the free axial expansion of the tube but also ensuring a perfect centring of the system of tubes in the mould. The mould itself is produced either in sand, metal or a mixture, under the usual conditions for the casting of aluminum alloys. The alloys usually employed are AS7G or AS5U3G in the Y20,23 or Y30,33 states in accordance with AFNOR NF-A-57702 Standard.

The dimensions between tap centres will be adjusted, in relation to the desired dimensions, by an amount which takes into account the deformations of the main tube during the casting and the solidification of the part: namely elongation under the effect of the heat of the liquid metal and shrinkage when the part solidifies.

The temperature for casting the part is the lowest possible temperature which makes it possible to obtain correct production of the part and non-melting of the tube. The casting temperature is less than or equal to 760° C. and preferably between 720° C. and 740° C.

By way of indication, the usual internal diameters of the tubes employed are generally between 3 and 15 mm.

It is preferably to choose the alloys for the tube or system of tubes and for the cast part in such a manner that the melting point of the alloy of the moulded part is less than or equal to that of the metal (or alloy) constituting the tube (or system of tubes).

During the filling phase, the contact time between the system of tubes and the molten metal must be less than 10 seconds, and preferably 5 seconds.

The tube (or system of tubes) may also be cooled during the casting operation by a circulation of a cooling fluid, such as compressed air or liquid nitrogen vapour.

The invention will be better understood with the help of the following example, illustrated by FIGS. 1 to 3, reproducing the conditions of casting a part of cylinder head.

For the purpose of clarity of the drawings, the supply system of the gravity-cast part is not represented.

FIG. 2 shows in cross-section the detail of the joining of a tap on the main tube by means of a collar which is formed and sticked (FIGS. 2A to 2D) at various stages of forming.

Figure 3A:
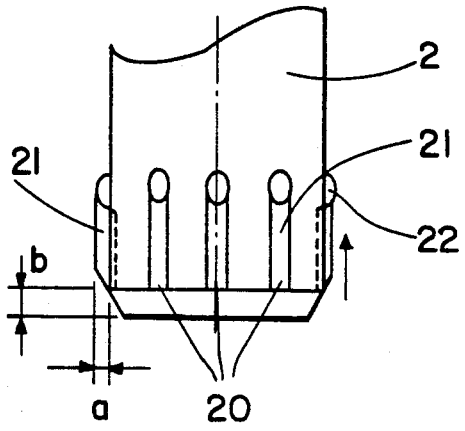
Figure 3B:
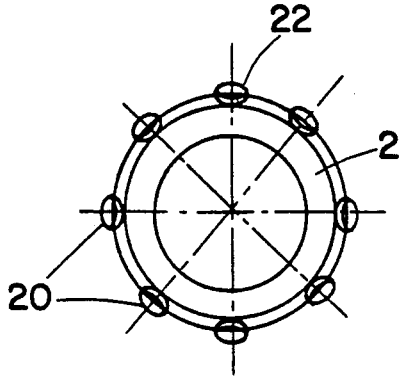
Figure 3C:
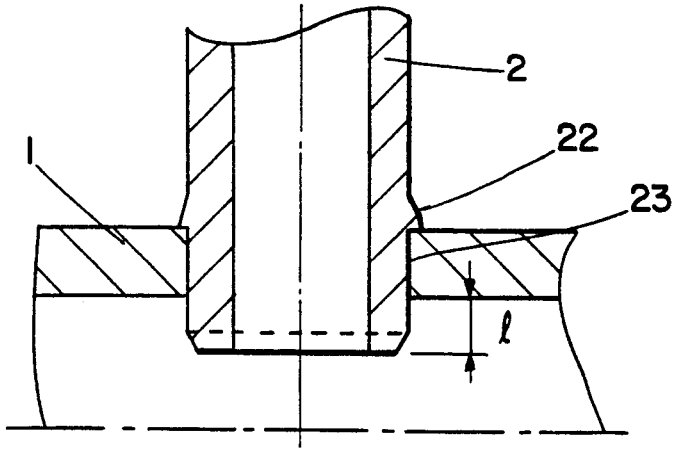

FIG. 3 represents the detail of the joining of a tap on the main tube by press-fitting, FIG. 3A being a front view of a tap, FIG. 3B an end view and FIG. 3C an axial cross-section of the press-fit obtained.

DESCRIPTION OF THE PREFERRED EMBODIMENT(S)

A tube 1 equipped with 3 closed taps 2 is placed in a mould 3 constituted by a lower portion 4 and an upper portion 5, resting against each other at the parting line 6; the tube 1 has the following dimensions: 12×8 mm in diameter and the taps 6×4 mm in diameter. The mould is constituted by a PET-SET mixture from the ASHLAND AVEBENE company, the composition of which is:

55AFA silica isocyanate: 0.6% (by weight)

phenolic resin: 0.6% (by weight)

PP ¾ catalyst=20% of the quantity of resin (by weight).

The taps are equipped with a collar 7, which is formed and adhesively secured to onto the main tube 1 by means of a cyanoacrylic adhesive 10 (Black Max from the LOCTITE company).

The main tube 1 possesses an end elbow 8 placed in the portion 9 of the mould 3, with a clearance 12 between 1 and 2 mm, which makes it possible to position accurately the tube (1) equipped with its taps in the mould 3. The other flattened end 13 of the 50 cm long tube 1 is straight and may slide in the portion 10 of the mould 3 (free thermal expansion towards the outside of the mould).

Figure 1A:
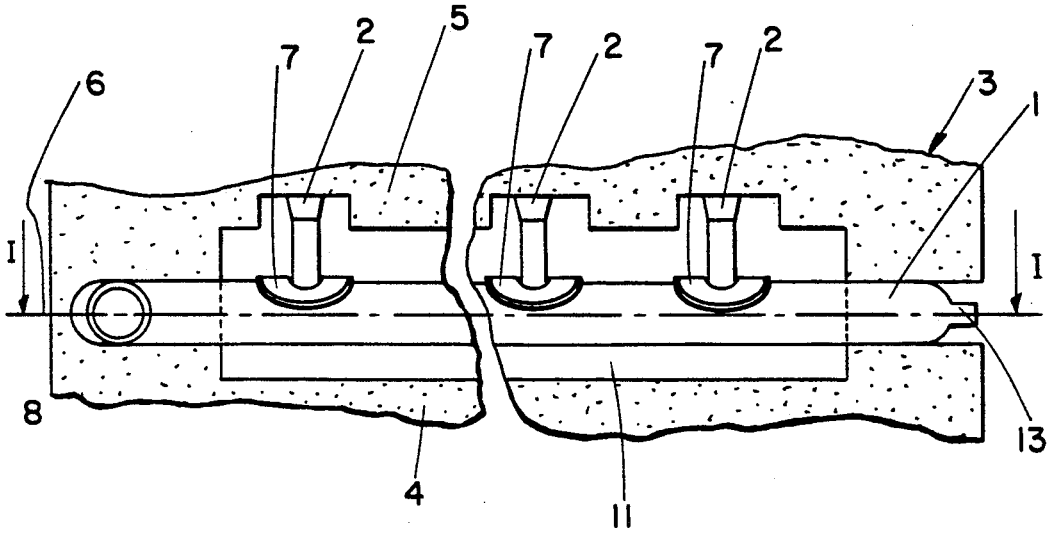
FIG. 1 represents a sectional view of a tube and its taps in place in a casting mould, in front view (1A) according to the line II—II of FIG. 1B and as a plan view (1B) according to the line I—I of FIG. 1A.
Figure 1B:
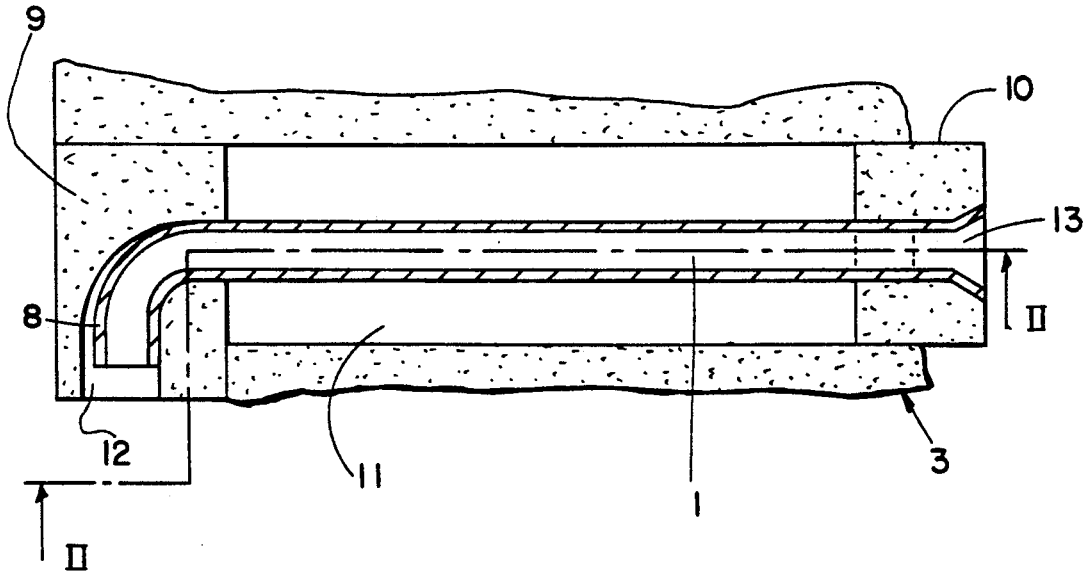
Figure 2A:
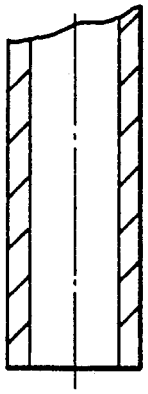
Figure 2B:
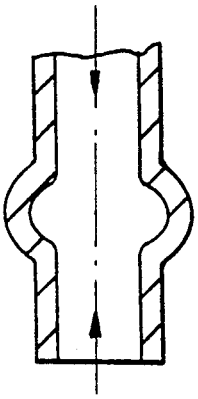
Figure 2C:
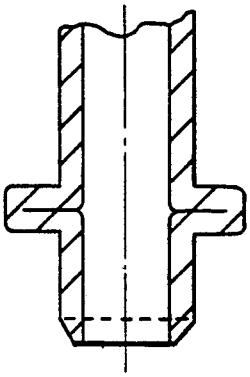
Figure 2D:
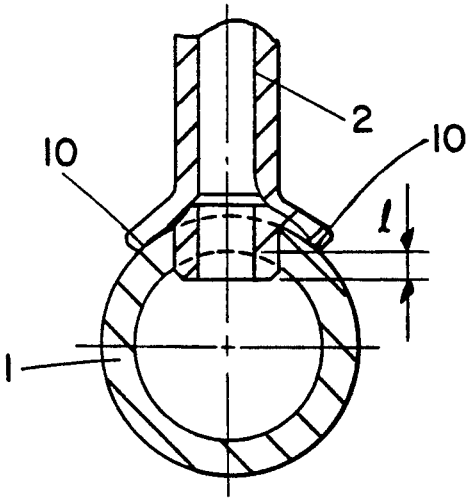

The collars are obtained by axial compression of the tube 2 constituting the taps (FIGS. 2A, B and C) and after forming, these collars are cemented on the tube 1 (FIG. 2D).

The penetration of the tap into the tube takes place over a length 1 of the order of an mm.

The tube 1 and its taps are positioned in the mould 3, as has just been described, and an AS5U3G alloy is poured into the cavity 11 at a temperature of 730° C. and at a speed of 120 l/minute.

After solidification, the part equipped with its system of integrated channels is demoulded, and its extra lengths that are of no use, 8 and 13, for example, are subsequently removed.

Another method of joining the tap 2 onto the tube 1 is represented in FIG. 3.

It consists in creating, by embossing at the end of the tap, longitudinal ribs 20 on its external face, which creates slight longitudinal flanges 21 of height a (approximately 0.3 mm) and an end flange 22.

The tube is then chamfered over a length b of the order of an mm, then press-fitted into the opening 23 of the tube 1 until the flanges 22 acting as a stop ensure the depth of penetration 1 which is sought.

The process according to the invention makes it possible to obtain parts having a system of internal channels which may have a complex pattern, without resorting to accurate and lengthy machining on specialised machines, and without having to plug up again the exits of the machined channels which are not of use in service but are simply required by the steps in the piercing operations.

This simple and inexpensive process is suitable for the mass production of all kinds of moulded parts such as cylinder heads, compressor cylinders and valves, lubrication systems, convectors etc.

We claim:

1. Process for casting a part made of Al or an Al alloy and containing integrated channels, comprising the steps of:

(a) placing at least a tube (1), made of aluminum or an alloy thereof of thickness greater than or equal to 1 mm, which is previously formed, in a mold (3) with ends of the tube being on the outside of a mold cavity or inserted into cores;

(b) pouring molten aluminum or an alloy thereof into the cavity of the mold and allowing the molten metal to solidify; and (c) demolding and eliminating surplus end portions of the tube, wherein prior to said pouring taps (2) are fixed to the tube (1) by press fitting in apertures provided therein and an end of the tap (2) is provided with longitudinal ribs (20) obtained by embossing before press fitting.

2. Process for casting a part made of Al or an Al alloy and containing integrated channels, comprising the steps of:

(a) placing at least a tube (1), made of aluminum or an alloy thereof of thickness greater than or equal to 1 mm, which is previously formed, in a mold (3) with ends of the tube being on the outside of a mold cavity or inserted into cores;

(b) pouring molten aluminum or an alloy thereof into the cavity of the mold and allowing the molten metal to solidify; and (c) demolding and eliminating surplus end portions of the tube, wherein the molded part, made of aluminum or an aluminum alloy, is a cylinder head, and prior to said pouring taps (2) are fixed to the tube (1) by press fitting in apertures provided therein; and an end of the tap (2) is provided with longitudinal ribs (2) obtained by embossing before press fitting.

3. Process for casting a part made of Al or an Al alloy and containing integrated channels, comprising the steps of:

(a) placing at least a tube (1), made of aluminum or an alloy thereof of thickness greater than or equal to 1 mm, which is previously formed, in a mold (3) with ends of the tube being on the outside of a mold cavity or inserted into cores;

(b) pouring molten aluminum or an alloy thereof into the cavity of the mold and allowing the molten metal to solidify; and (c) demolding and eliminating surplus end portions of the tube, wherein prior to said pouring taps (2) are fixed to the tube (1) by press fitting in apertures provided therein, and the outer diameter of the tap end or ribs is up to 5/10 of a mm greater than the apertures provided in the tube.

4. Process for casting a part made of Al or an Al alloy and containing integrated channels, comprising the steps of:

(a) placing at least a tube (1), made of aluminum or an alloy thereof or thickness greater than or equal to 1 mm, which is previously formed, in a mold (3) with ends of the tube being on the outside of a mold cavity or inserted into cores;

(b) pouring molten aluminum or an alloy thereof into the cavity of the mold and allowing the molten metal to solidify; and (c) demolding and eliminating surplus end portions of the tube, wherein the molded part, made of aluminum or an aluminum alloy, is a cylinder head, and taps prior to said pouring (2) are fixed to the tube (1) by press fitting in apertures provided therein, and the outer diameter of the tap end or ribs is up to 5/10 of a mm greater than the apertures provided in the tube.

5. Process according to any one of claims 1, 2, 3, or 4 wherein the tap or taps (2) penetrate(s) into the tube (1).

6. Process according to claim 5, wherein the penetration of the tap into the tube (1) is of the order of a mm.

7. Process according to any of claims 1, 2, 3, or 4 wherein the melting point of the tue is greater than or equal to that of the cast alloy constituting the molded part.

8. Process according to any of claims 1, 2, 3, or 4 wherein the alloy constituting the part cast is commercially type A5 pure aluminum.

9. Process according to any of claims 1, 2, 3, or 4 wherein the pouring temperature is less than 760° C.

10. Process according to claim 9, wherein the pouring temperature is between 720° C. and 740° C.

11. Process according to claim 9, wherein a contact time between the tube and the molten metal is less than 10 seconds.

12. Process according to claim 9, wherein the contact time between the tube and the molten metal is 5 seconds.

* * * * *